United States Patent [19]

Mitlmeier et al.

[11] Patent Number: 4,876,522

[45] Date of Patent: Oct. 24, 1989

[54] ELECTROMAGNETIC SWITCHGEAR

[75] Inventors: Norbert Mitlmeier, Amberg; Bardo Koppmann, Kaltenbrunn, both of Fed. Rep. of Germany

[73] Assignee: Siemens Aktiengesellschaft, Berlin and Munich, Fed. Rep. of Germany

[21] Appl. No.: 248,428

[22] Filed: Sep. 23, 1988

[30] Foreign Application Priority Data

Sep. 25, 1987 [DE] Fed. Rep. of Germany ..... 3732428

[51] Int. Cl.[4] ..... H01H 3/60; H01H 51/08

[52] U.S. Cl. ..... 335/193; 335/131

[58] Field of Search ..... 335/193, 157, 158, 131, 335/277

[56] References Cited

FOREIGN PATENT DOCUMENTS 2215657 9/1978 Fed. Rep. of Germany ..... 335/193

*Primary Examiner*—H. Broome

*Attorney, Agent, or Firm*—Kenyon & Kenyon

[57] ABSTRACT

An electromagnetic switchgear having a housing top and a bottom plate is constructed such that the bottom plate is resiliently held relative to the housing top to avoid damaging the housing top and bottom plate during operation. Elastic damping elements are interposed between the bottom plate and the housing top by screwing the bottom plate to the housing top. The bottom plate suspension is especially suitable for electromagnetic switchgear, such as contactors.

7 Claims, 1 Drawing Sheet

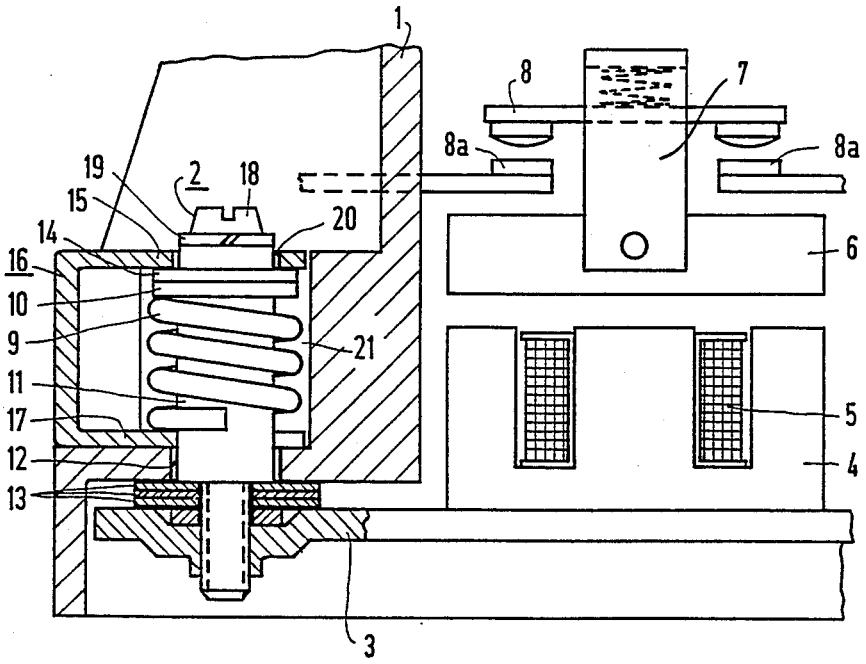
1
8
7
8a
8a
19
2
18
15
20
14
16
6
10
9
21
11
5
17
12
4
13
3

ELECTROMAGNETIC SWITCHGEAR

FIELD OF THE INVENTION

This invention relates to the field of electromagnetic switchgear and, more particularly, to switchgear having a fixed magnet part disposed in a housing top and a movable contact part coupled with a movable switching magnet part guided in the housing top. Further, the electromagnetic switchgear has a bottom plate, holding the non-switching magnet part, which is screwed to the housing top and closes off the housing top.

BACKGROUND OF THE INVENTION

In a known electronic switching device of the above-mentioned type, such as German patent No. 24 15 489 screws connect the bottom plate with the housing top. The screw have their heads braced against the housing top through a disk and several split rings. The threads of the screws are screwed into corresponding threaded holes in the bottom plate. Tolerance compensating pieces may be inserted between the housing top and bottom plate. To prevent damage to the bottom plate as the magnet switches, the bottom plate must be made relatively thick. However, due to the rigid design of the bottom plate and the rigid support of the non-switching magnet part on the bottom plate, dents to the magnet system may occur upon switching. The dents also have an adverse effect on the switching.

It is also known for the mounting of a complete contact box in the case of contactors to secure this box on a support frame using annular elastic elements through which bolts are passed as shown in French Pat. No. 1,406,946 and Great Britain Pat. No. 1,064,648.

Thus, there is a need to devise a bottom plate suspension system which, at least within certain limits eliminates any denting of the magnet system while providing for a simple and inexpensive construction.

SUMMARY OF THE INVENTION

A solution to the above problem is achieved in a simple manner by associating with the screws resilient damping elements which permit the bottom plate to move relative to the housing part. This eliminates the need for additional damping elements between the magnet part and the housing.

In order to elastically suspend the bottom plate in the switch-on direction of the magnet system it is an advantage of the present invention to use damping elements made of compression springs. One end of the compression springs braces either directly or indirectly against the screw head while the other end braces against the housing top. The bottom plate advantageously lies in a depression of the housing top when the screw threads are screwed into the bottom plate so that attachment of the device to the attachment surface is not impaired.

Further, the compression spring is guided on a bushing which spans the thread of the screw and is provided with a compression spring support collar applying either directly or indirectly against the screw head. The bushing end away from the support collar is pressed against the bottom plate by the screw. The compression spring is held under initial tension by the legs of a U-shaped holder one leg of which applies against the housing top to form a shock absorber. The shock absorber can be preassembled as a complete unit and be screwed in like an ordinary fastening screw.

It is a further advantage if the holder is made of a plastic material and is inserted into an opening in the housing top adapted to fit the holder. This gives the visual impression that the continuous closed surface of the housing top is not impaired by the holder.

Also, in the switchgear design according to the present invention, as in the prior art, tolerance compensating rings can be inserted as an intermediate layer in a simple manner. However, in contrast to the prior art where the adjusting disks are fastened with claws on a holding piece of the bottom plate, in the present invention the compensating rings can be introduced as a unit with the screw itself.

BRIEF DESCRIPTION OF THE DRAWING

The drawing shows a schematic view of the present invention.

DETAILED DESCRIPTION

The switchgear shown schematically in the drawing is made of a housing top 1 and a bottom plate 3 coupled therewith by screws 2. On the bottom plate 3, a non-switching magnet part 4 is firmly connected with the exciter coil 5. In the housing top 1, fixed contacts 8a and a contact bridge support are fastened thereto. Further, the contact bridge support 7 for the contact bridges 8, coupled with the switching magnet part 6, is displaceably guided counter to the force of a return compression spring in a known manner.

To couple the bottom plate 3 with the housing top 1 the screws 2 have associated with them resilient damping elements such as compression springs 9. The compression springs 9 are guided on a bushing 11 provided with a supporting collar 10. The bushing 11 is passed through a bore 12 in the housing top 1 and presses against tolerance compensating rings 13 inserted between the housing top 1 and the bottom plate 3. The supporting collar 10 via a disk 14 braces against the leg 15 of a U-shaped holder 16. The spring 9 is braced against the other leg 17. Leg 17 forms a forked end for insertion of the bushing 11. The other end of the spring 9 presses against the supporting collar 10. The holder 16, screw 2, bushing 11, compression spring 9, disk 14 and spring ring 19 form a shock absorbing unit.

The screw head 18 having a spring ring 19 is passed through an opening 20 in the leg 15. To insert the screw into the holder 15, an obliquely set screw having head 18 and the spring ring 19 is first pushed through the opening 20. Next the spring 9 is slightly tensioned. By pivoting the spring 9 around the bearing surface of disk 14 at leg 15 the bushing is pivoted into the holder from the position seen in the drawing so that the spring is braced in the holder 16 under pre-stress. The shock absorbing unit can then be placed into an opening 21 in the housing top 1 as a complete structural part. This causes the bushing 11 to go through the bore 12, and the thread of screw 2 is screwed into threaded holes in the bottom of plate 3.

In operation, as the switchgear switches, the switching magnet part 6 strikes against the non-switching magnet part 4. The impacts of the switching is transmitted to the bottom plate 3. Breaking the bottom plate and the housing is precluded, as the compression spring 9 can compress such that the bottom plate 3 separates from the housing top 1. For this purpose, an appropriate cutout is provided at the bottom of the housing top so that the bottom plate can move freely even with the switchgear screwed on.

Therefore, with the bottom plate suspension according to the invention, additional damping elements for the nonswitching magnet part can be omitted. The damping by the compression spring 9 is easy to adjust and insertion of the structural part preassembled in the holder 16 requires no special skill or diligence, as any screw will suffice.

What is claimed is:

1. An electromagnetic switchgear having a housing top comprising:

(a) a movable switching magnet part;

(b) a movable contact part coupled with said movable switching magnet part and guided in the housing top;

(c) a fixed contact part disposed in said housing top;

(d) a bottom plate holding a non-switching magnet part, said bottom plate closing off the housing top;

(e) at least one screw having a screw head and screw threads which couple the housing top to the bottom part;

(f) at least one resilient damping element associated with said screw and which permits movement of the bottom plate relative to the housing part and further wherein the bottom plate has a bore which receives said screw threads and the at least one damping element comprises a compression spring braced at one end either directly or indirectly against the screw head and, at the other end, against the housing top.

2. An electromagnetic switchgear according to claim 1, further comprising a bushing having a supporting collar for the compression spring, wherein said bushing spans the screw threads and serves as a guide for the compression springs, and said supporting collar presses either directly or indirectly against the screw head, the end of said bushing opposite from the supporting collar being pressed by the screw against the bottom plate.

3. An electromagnetic switchgear according to claim 2, further comprising a plurality of tolerance compensating rings spanning the screws, said compensating rings being braced on one side against the bottom plate and on their other side against both the end of the bushing opposite the supporting collar and against the housing top.

4. An electromagnetic switchgear according to claim 1, further comprising a U-shaped holder having first and second legs, said legs holding the compression spring under initial tension with said first leg pressing against the housing top.

5. An electromagnetic switchgear according to claim 4, wherein the holder is made of a plastic material.

6. An electromagnetic switchgear according to claim 4, wherein the housing top has an opening adapted for receiving the holder.

7. An electromagnetic switchgear according to claim 1, wherein the housing top has a depression in which the bottom plate lies.

* * * * *